US007124486B2

(12) United States Patent
Etienne

(10) Patent No.: US 7,124,486 B2
(45) Date of Patent: Oct. 24, 2006

(54) FAST AND AUTOMATED TOOL-CHANGING DEVICE WITH STANDARD CONICAL TOOL SUPPORT FOR DIGITALLY CONTROLLED BENDING MACHINE

(75) Inventor: Joël Etienne, Saint Die (FR)

(73) Assignee: Macsoft. S.A., Saint Michel sur Meurthe (FR)

( * ) Notice: Subject to any disclaimer, the term of this patent is extended or adjusted under 35 U.S.C. 154(b) by 198 days.

(21) Appl. No.: 10/415,536

(22) PCT Filed: Sep. 10, 2001

(86) PCT No.: PCT/FR01/02794

§ 371 (c)(1),
(2), (4) Date: Sep. 25, 2003

(87) PCT Pub. No.: WO02/36280

PCT Pub. Date: May 10, 2002

(65) Prior Publication Data

US 2004/0050136 A1 Mar. 18, 2004

(30) Foreign Application Priority Data

Oct. 31, 2000 (FR) ..... 00 13969

(51) Int. Cl.

| | |
|---|---|
| ***B21B 15/00*** | (2006.01) |
| ***B21D 39/03*** | (2006.01) |
| ***B23P 23/04*** | (2006.01) |
| ***B23P 25/00*** | (2006.01) |
| ***B21J 7/46*** | (2006.01) |

(52) U.S. Cl. ..... 29/33 R; 72/481.3; 72/481.6; 72/444; 409/231; 409/233

(58) Field of Classification Search ..... 483/28, 483/55; 409/231, 233; 72/481.1, 481.3, 72/481.6, 444; 29/33 R See application file for complete search history.

(56) References Cited

U.S. PATENT DOCUMENTS

| | | | | |
|---|---|---|---|---|
| 3,857,271 | A | 12/1974 | Gott et al. | |
| 3,868,886 | A * | 3/1975 | Bondie | 409/233 |
| 4,248,273 | A | 2/1981 | Marcello | |
| RE31,288 | E * | 6/1983 | Matsuzaki et al. | 29/27 C |
| 4,766,756 | A * | 8/1988 | Shiue | 72/294 |
| 4,993,253 | A * | 2/1991 | Del Fabro et al. | 72/307 |
| 5,025,651 | A | 6/1991 | Del Fabro et al. | |
| 5,375,447 | A | 12/1994 | Del Fabro et al. | |

(Continued)

FOREIGN PATENT DOCUMENTS

| | | |
|---|---|---|
| EP | 0349953 | 1/1990 |

(Continued)

*Primary Examiner*—Monica Carter
*Assistant Examiner*—Eric A. Gates
(74) *Attorney, Agent, or Firm*—Gary M. Cohen

(57) ABSTRACT

A digitally controlled machine for bending, forming, folding or coiling a bar conventionally includes a frame, and a rotary bending tool for producing bends in different planes. A bar is moved along an axis and is brought through a bending snout associated with the frame, and then through a bending tool which is movable relative to the axis by a motor-driven turner. The bending tool is received by a standard conical tool support, and the turner is combined with means for automatically clamping and unclamping the jaws of a gripper associated with the turner. The jaws of the gripper are automatically unclamped when the turner reaches the end of its axial stroke, away from the bending station, and are automatically clamped when the turner begins its axial movement in the opposite direction, toward the bending station.

9 Claims, 1 Drawing Sheet

U.S. PATENT DOCUMENTS 6,813,922 B1 11/2004 Etienne

FOREIGN PATENT DOCUMENTS

| | | |
|---|---|---|
| EP | 0850707 | 7/1998 |
| FR | 2553314 | 4/1985 |
| FR | 2715334 | 7/1995 |
| FR | 2806943 | 10/2001 |
| WO | WO 9926739 | 6/1999 |
| WO | WO 0174509 | 10/2001 |

* cited by examiner

FAST AND AUTOMATED TOOL-CHANGING DEVICE WITH STANDARD CONICAL TOOL SUPPORT FOR DIGITALLY CONTROLLED BENDING MACHINE

BACKGROUND OF THE INVENTION

The present invention relates to a tool-changing device for a digitally controlled machine for curving, forming, folding and bending bars or sections.

The main objective of the invention is to produce a fast and automated tool-changing device, something which did not previously exist for machines of this general type.

SUMMARY OF THE INVENTION

The tool-changing device of the present invention can be used, in particular, but without limitation, with digitally controlled machines having retractable or resettable snouts, such as is described in commonly owned French Patent Application No. 00 04317.

A digitally controlled machine is provided for curving, forming, folding or bending a bar which conventionally includes a bed (B) and a rotary bending tool (1), of the type shown in FIGS. 1 and 2 of the drawings, for obtaining folds in various planes. A bar to be operated upon is moved along a line of travel and passed through a folding snout (S) carried by the bed (B) of the machine, and then through a folding tool (3). Axial movement of the folding tool, perpendicular to the line of travel of the bar, is transmitted from a motor by means of a turner.

In accordance with the present invention, the folding tool is carried by a standard conical tool support, and the turner is combined with automatic means for controlling a tool-engaging gripper. Jaws of the gripper are loosened when the turner reaches the end of its axial travel, in a direction away from the folding station, and the jaws are automatically tightened when the turner begins its axial movement in the opposite direction, i.e., in a direction toward the folding station.

In a preferred but nonlimiting embodiment of the present invention, the function of automatically loosening and tightening the gripper is tied to the function of digitally moving the turner in an axial direction, and such functions are performed by the same means.

The present invention will be better understood with reference to the non-limiting description of an embodiment of the invention which is provided below, in conjunction with the following drawings.

DETAILED DESCRIPTION OF THE INVENTION

In the description which follows, the tool-changing device of the present invention is combined with an assembly of a type which is already in use on other machine tools and for various different machining applications; namely, a standard assembly which includes a conical tool holder (1) and a gripper (2).

Figure 1:
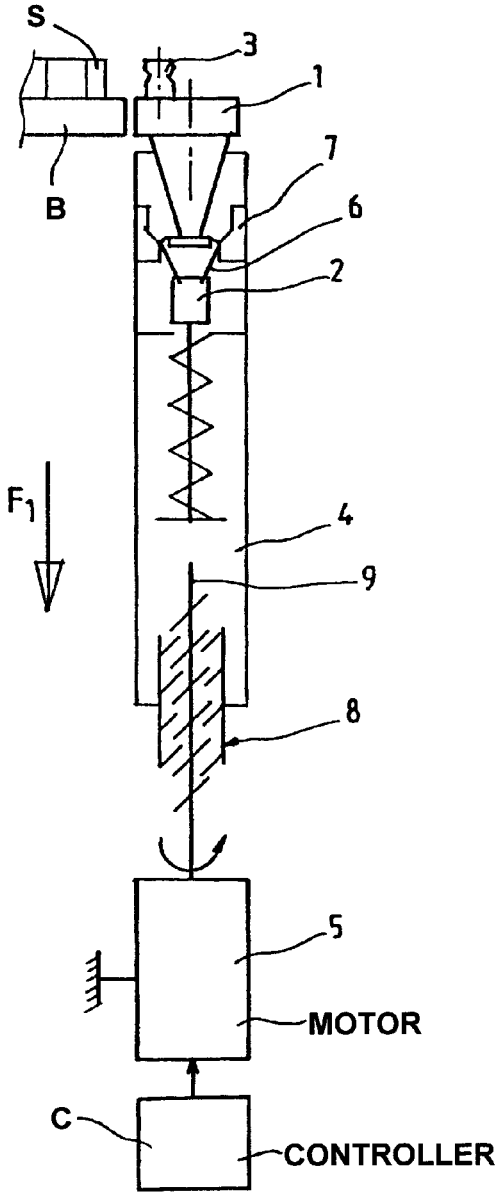
FIG. 1 diagrammatically illustrates the tool-supporting gripper of the present invention in a tightened position, for gripping a tool.
Figure 2:
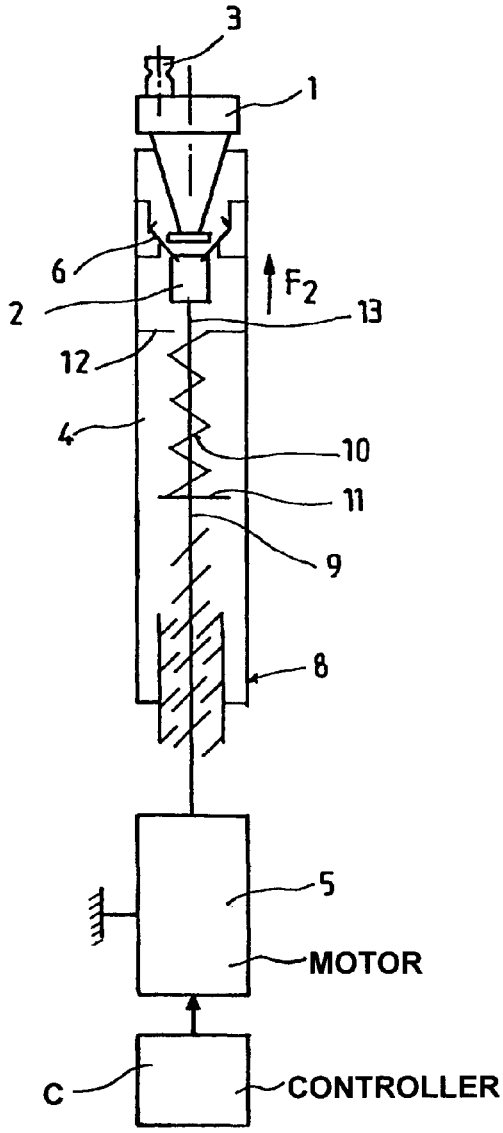
FIG. 2 shows the tool-supporting gripper of FIG. 1 in the loosened position, for releasing the tool.

In the embodiment depicted in FIGS. 1 and 2, the tool holder (1), together with the tool (3), is releasably secured by the gripper (2) to a transmission assembly which is generally known as a turner (4), for transmitting movements from an electric motor (5) which is associated with the digitally controlled machine and which is operated responsive to a controller (C). The turner (4) also makes it possible, in known fashion, to move the tool holder (1) in translation so as to move the tool (3) away from the folding station, or to position the tool (3) with respect to the folding station.

In accordance with the present invention, jaws (6) of the gripper (2) are automatically tightened over the tool holder (1), and are loosened following translational movement of the turner (4), for example, as is illustrated in the embodiment shown in FIGS. 1 and 2.

In the tightened position which is shown in FIG. 1, the jaws (6) of the gripper (2) are compressed inside a narrowed part of a conical stop (7), and grip the end of the tool holder (1). To this end, the screw-nut system (8) which provides for axial positioning of the turner (4) drives the turner axially in the direction of the motor (5), i.e., in the direction of the arrow $\vec{F}_1$.

At the end of its travel (see FIG. 2), the axle (9) of the screw-nut system (8) comes into contact with the end of a rod (13) which provides for axial guidance of the gripper (2), within the turner (4). This drives the gripper (2) in an axial movement, relative to the turner, in the direction of the arrow $\vec{F}_2$, which is opposite to the direction of the arrow $\vec{F}_1$. The gripper (2) moves closer to the conical stop (7) and the jaws (6), under the effect of a spring which is situated in the gripper (2), so that portions of the jaws (6) are received in the widened part of the conical stop (7). As a result, the end of the tool holder (1) is automatically released from the gripper (2).

A device which is commonly used in machine tools of this general type for purposes of machining a workpiece (not shown) is capable of changing different assemblies comprised of a tool holder (1) and a tool (3), which are drawn from an automated tool storage rack. Thus, the number of fold radii per workpiece becomes limited only by the variety of tools in the storage rack.

The axial movement of the gripper (2) relative to the turner (4), in the direction of the arrow $\vec{F}_2$, also has the effect of compressing a tension spring (10) which is positioned between a moving stop (11) associated with the end of the axial guide rod (13) and a fixed stop (12) associated with the turner (4). When the turner (4) begins its return travel, in the direction opposite to the direction of the arrow $\vec{F}_1$, the spring (10) will automatically move the gripper (2) away from the conical stop (7), causing the jaws (6) of the gripper to automatically engage the tool holder (1).

When the spring (10) reaches it normal tension position, which is defined by the length of the rod (13) which provides for axial guidance of the gripper (2), the axle (9) of the screw-nut system (8) separates from the end of the rod (13). The gripper (2), in the remainder of its movement, then exerts a constant force on the cone or taper of the tool holder (1) which is determined by the spring (10).

In the foregoing embodiment, the functions of automatically loosening and tightening the gripper (6) are tied to the function of digitally moving the turner (4) in an axial direction, and consequently, these functions are performed by the same means.

It is possible to envisage other embodiments in which the functions of automatically tightening and loosening the gripper are separate from the digital, axial movement function, with the result that the two functions are then performed by separate means. For example, the tightening and loosening functions can be driven by hydraulic or pneumatic rams, which can be external to the turner.

The invention claimed is:

1. A digitally controlled machine for curving, forming, folding and bending a bar, comprising:

a bed, a folding snout coupled with the bed, and a rotary bending tool associated with the bed and coupled with the folding snout, wherein the bending tool is carried by a conical tool support for obtaining folds in selected planes, and wherein the bar is movable along a line of travel through the folding snout and past the bending tool;

a turner coupled with a motor and the tool support, wherein the tool support is axially movable by the turner in a direction which is perpendicular to the line of travel of the bar; and a gripper coupled with the turner and having jaws for selectively engaging the tool support, wherein the jaws of the gripper are automatically tightened and loosened so that the jaws are automatically loosened when the turner reaches an end of axial travel in a direction away from the bending tool and the folding snout, and so that the jaws are automatically tightened when the turner moves axially in an opposite direction, toward the bending tool and the folding snout;

wherein the automatic loosening and tightening of the gripper is coupled with movement of the turner in an axial direction so that the automatic loosening and tightening of the gripper and the axial movement of the turner is performed by the same apparatus.

2. The machine of claim 1 which further includes a conical stop associated with the turner and coupled with the gripper, wherein the conical stop includes narrowed portions, and wherein the jaws of the gripper are compressed by the narrowed portions of the conical stop, for gripping an end of the tool support.

3. The machine of claim 2 which further includes a screw-nut system associated with the turner, for axially moving the turner responsive to operation of the motor.

4. The machine of claim 3 wherein the screw-nut system includes an axle for engaging an end of a rod associated with the gripper, wherein the rod axially guides the gripper within the turner, and wherein, at an end of travel of the axle, the screw-nut system comes into contact with the end of the rod and drives the gripper in an axial movement relative to the turner.

5. The machine of claim 4 which further includes a first tension spring associated with the gripper, and wherein, when the gripper is moved toward the conical stop and the jaws, responsive to the first tension spring, the jaws are received in a widened part of the conical stop, automatically releasing the end of the tool support.

6. The machine of claim 5 which further includes a second tension spring associated with the axle of the screw-nut system, wherein the second tension spring is positioned between a moving stop associated with an end of the rod of the gripper and a fixed stop associated with the turner, and wherein axial movement of the gripper in a first direction, relative to the turner, compresses the second tension spring between the moving stop and the fixed stop.

7. The machine of claim 6 wherein, responsive to axial movement of the turner in a second direction opposite to the first direction, the second tension spring automatically moves the gripper away from the conical stop, automatically gripping the tool support with the jaws of the gripper.

8. The machine of claim 7 wherein the rod has a defined length, wherein the second tension spring has a normal tension position which is defined by the length of the rod, and wherein the axle of the screw-nut system separates from the end of the rod when the second tension spring reaches the normal tension position.

9. The machine of claim 8 wherein, following separation of the axle of the screw-nut system from the end of the rod, the gripper exerts a constant force on the end of the tool support which is determined by the second tension spring.

* * * * *